US008276502B1

(12) United States Patent
Wright

(10) Patent No.: US 8,276,502 B1
(45) Date of Patent: Oct. 2, 2012

(54) AMBIDEXTROUS SAFETY LEVER

(76) Inventor: Robert Wright, Lyons, OR (US)

( * ) Notice: Subject to any disclaimer, the term of this patent is extended or adjusted under 35 U.S.C. 154(b) by 91 days.

(21) Appl. No.: 13/006,577

(22) Filed: Jan. 14, 2011

Related U.S. Application Data

(60) Provisional application No. 61/295,813, filed on Jan. 18, 2010.

(51) Int. Cl.
*F41A 17/74* (2006.01)

(52) U.S. Cl. ..... 89/148; 42/70.08; 42/70.01

(58) Field of Classification Search ..... 42/70.01–70.11; 89/142, 148, 150, 154
See application file for complete search history.

(56) References Cited

U.S. PATENT DOCUMENTS 3,964,366 A * 6/1976 Atchisson ..... 89/148
5,760,328 A 6/1998 Robbins
7,243,453 B2 * 7/2007 McGarry ..... 42/70.08
7,360,331 B2 * 4/2008 McGarry ..... 42/70.02
7,661,219 B1 * 2/2010 Knight et al. ..... 42/70.02
7,661,220 B2 * 2/2010 Crandall et al. ..... 42/70.06
8,047,119 B2 * 11/2011 Hochstrate et al. ..... 89/142
2003/0208940 A1 * 11/2003 Johnson ..... 42/18
2005/0229462 A1 * 10/2005 McGarry ..... 42/70.08
2006/0123683 A1 * 6/2006 Garrett et al. ..... 42/6
2007/0180984 A1 * 8/2007 Huther ..... 89/148

* cited by examiner

*Primary Examiner* — Michael David
(74) *Attorney, Agent, or Firm* — Dwayne E. Rogge; Schacht Law Office, Inc.

(57) ABSTRACT

This disclosure describes embodiments of an ambidextrous or reversible safety mechanism for firearms. The safety mechanism can be utilized on specific rifles and shotguns, for example an AK47, SAIGA or similar firearms, as a retrofit to reposition the existing safety mechanism to a configuration similar to or nearly identical to an AR15, M16 or similar firearms. In this way, personnel familiar with the safety operation of the AR15 or M16 will be able to operate the retrofit firearm without learning the operation of a new mechanism. Once retrofitted, the firearm safety mechanism will have the same visual appearance, action, and "feel" as the firearm with which they are familiar. The distance from the grip (trigger) to the engagement portion of the safety mechanism of the retrofit firearm will be very similar to that of the familiar firearm.

5 Claims, 5 Drawing Sheets

AMBIDEXTROUS SAFETY LEVER

RELATED APPLICATIONS

This application claims priority benefit of U.S. Ser. No. 61/295,813, filed Jan. 18, 2010.

BACKGROUND OF THE DISCLOSURE

Field of the Disclosure

This disclosure relates to firearm safety devices. In particular, a safety which extends from both the left and the right lateral side of the firearm for ambidextrous adjustment thereof

SUMMARY OF THE DISCLOSURE

Disclosed herein is a retrofit safety lever for a firearm. The safety lever comprises a pin, a first engagement lever, and a first fastener.

The pin comprises substantially cylindrical longitudinal end portions, a clearance/cam portion between the substantially cylindrical end portions, a non-cylindrical face surface on at least one longitudinal end face and a receiving surface parallel to a longitudinal axis of the pin.

The first engagement lever comprises a surface defining a clearance hole, a mating surface operatively configured to engage the non-cylindrical face surface of the pin to facilitate rotational engagement between the first engagement lever and the pin, a user engagement portion operatively configured to provide leverage to a user rotating the first engagement lever, an indicator portion operatively configured to display to the user the relative rotation position of the pin, and a first fastener. The first fastener in turn comprises a first end with a minor diameter smaller than the clearance hole in the first engagement lever, the first end being configured to engage the receiving surface of the pin, and a second end with a major diameter larger than the clearance hole in the first engagement lever.

The safety lever as described above may further comprise a second engagement lever and a second fastener. The second engagement lever in turn comprises a surface defining a clearance hole, a mating surface operatively configured to engage the non-cylindrical face surface of the pin opposite the first engagement lever to facilitate rotational engagement between the second engagement lever and the pin, a user engagement portion operatively configured to provide leverage to a user rotating the second engagement lever, and an indicator portion operatively configured to display to the user the relative rotation position of the pin. The second fastener in turn comprises a first end with a minor diameter smaller than the clearance hole in the second engagement lever, the first end being configured to engage the receiving surface of the pin, and a second end with a major diameter larger than the clearance hole in the second engagement lever.

The safety lever as described above may be arranged wherein the first engagement lever and second engagement levers are substantially identical. This arrangement will allow the engagement levers to be manufactured much less expensively, and allow for repositioning on either side of the firearm.

The safety lever as described above may further comprise a surface defining a spring receiver in each of the first and second engagement levers, an indexing member operatively configured to at least partially be received in each spring receiver, and a compression spring operatively configured to fit within each spring receiver and bias the indexing member toward an indexing recess of the firearm.

The safety lever as described may be configured wherein the mating surface of the first indexing lever and the non-cylindrical face surface of the pin are bilaterally configured to allow connection of the first indexing lever to the non-cylindrical face surface of the pin in at least two unique orientations at 180° opposition. This arrangement will allow the indexing lever to be positioned on either side of the firearm.

DESCRIPTION OF THE PREFERRED EMBODIMENTS

This disclosure relates to an ambidextrous or reversible safety mechanism for firearms. In one embodiment, the safety mechanism can be utilized on specific rifles and shotguns, for example an AK47, SAIGA or similar firearms, as a retrofit to reposition the existing safety mechanism to a configuration similar to or nearly identical to an AR15, M16 or similar firearms. In this way, personnel familiar with the safety operation of the AR15 or M16 will be able to operate the retrofit firearm without learning the operation of a new mechanism. Once retrofitted, the firearm safety mechanism will have the same visual appearance, action, and "feel" as the firearm with which they are familiar. The distance from the grip (trigger) to the engagement portion of the safety mechanism of the retrofit firearm will be very similar to that of the familiar firearm.

Figure 1:
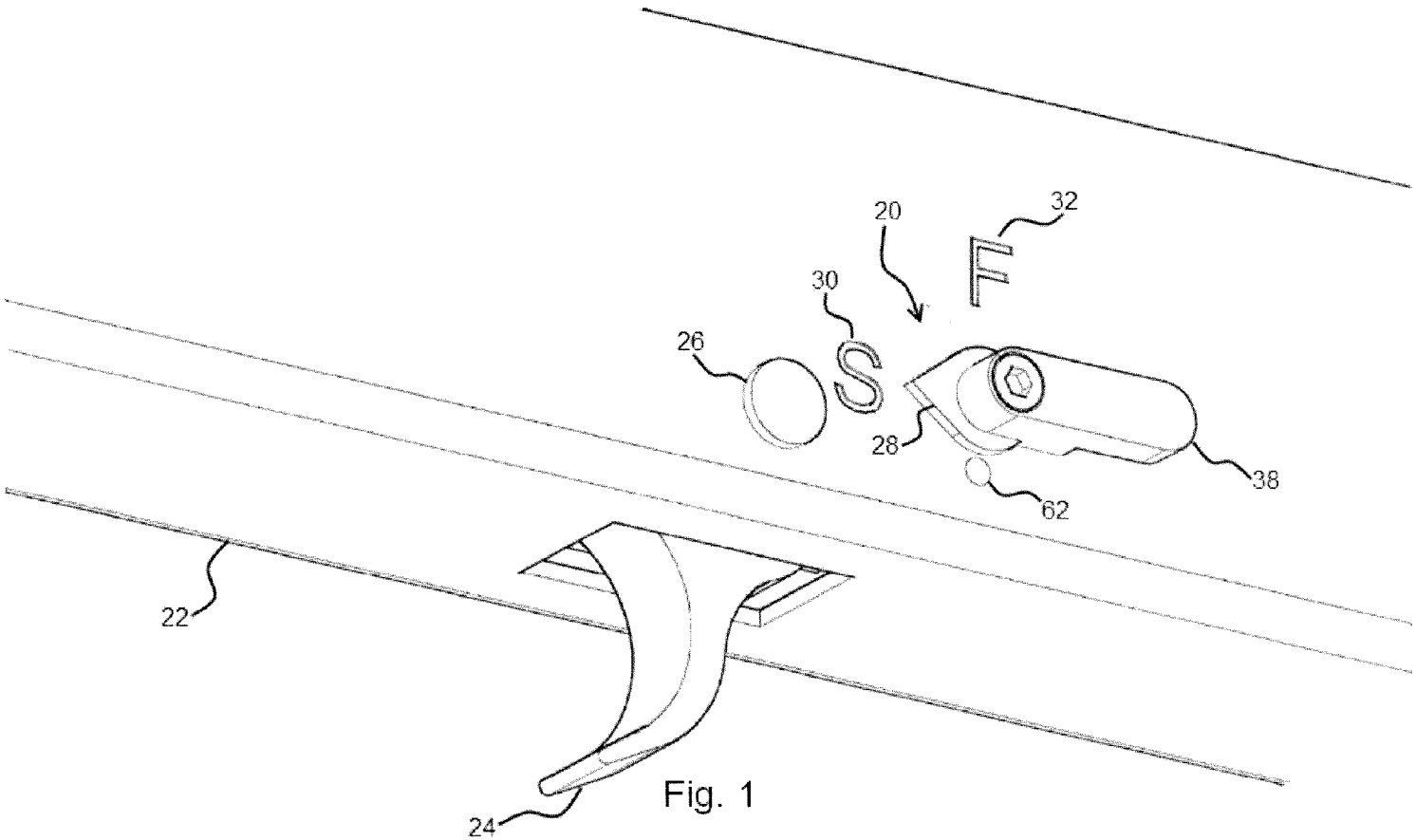
FIG. 1 is an isometric view of the ambidextrous safety lever, in one form.

Looking to FIG. 1, the ambidextrous safety lever 20 is shown attached to a firearm 22 in a way that will be described in more detail. Also shown is the firearm trigger 24, which pivots around a pivot bar 26, as is well known in the art. As shown in this embodiment, the ambidextrous safety lever 20 comprises an indicator portion 28, which, as shown, points towards a graphic representation 30. In one example, the graphic indicator 30 may indicate when the ambidextrous safety lever 20 is in a safe position, whereas a second graphic indicator 32 may indicate to the user when the ambidextrous safety lever 20 is repositioned to allow the firearm 22 to fire. Additional positions may be utilized, such as to indicate when the firearm is in automatic, manual, or semi-automatic mode.

Figure 2:
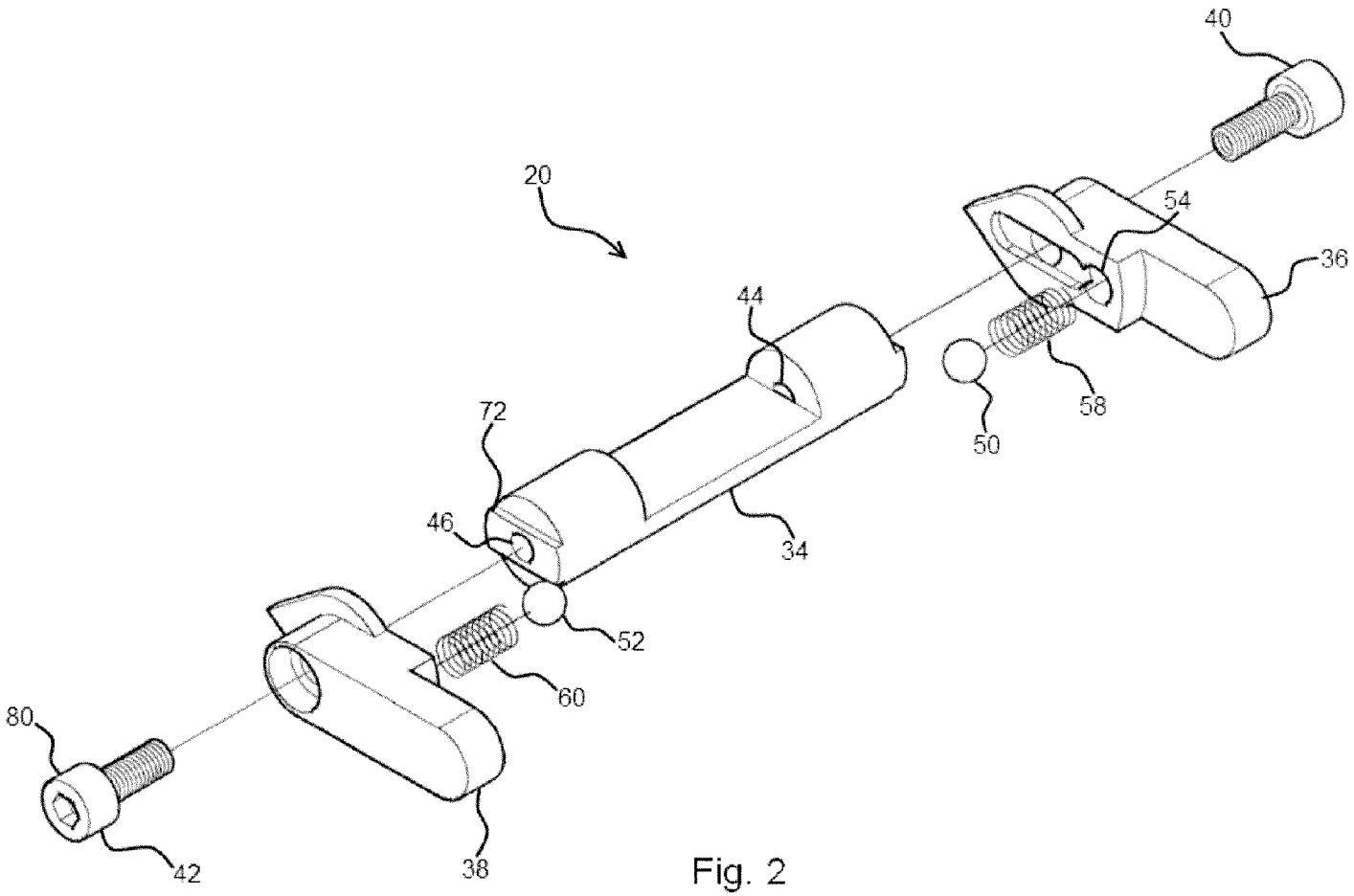
FIG. 2 is an isometric exploded view of the safety selector removed from the firearm, in one form.

Looking to FIG. 2, the inter-operating parts of the ambidextrous safety lever 20, in one form, are shown and will be described. One of ordinary skill in the art of designing and building firearm devices, especially rotating safety mechanisms, will be well-versed in a method for retrofitting firearms from their existing, single-sided safety device to the below disclosed ambidextrous safety lever. As shown, a central pin 34 in one embodiment is coupled to a plurality of engagement levers 36 and 38, as previously shown in FIG. 1. A plurality of fasteners 40 and 42 pass through a portion of each of the engagement levers 36 and 38 and are received by a plurality of receiving surfaces, such as tapped holes 44 and 46 in the pin 34. The hole 46 can be more easily seen in FIG. 6. Additionally, a plurality of indexing members (balls) 50 and 52 are placed within a plurality of spring receivers 54 and 56. The spring receiver 56 can be more easily seen in FIG. 3. The balls 50 and 52 are forced outward, away from the levers 36 and 38, by way of a plurality of compression springs 58 and 60, which are also positioned within the spring receivers 54 and 56. The compression springs 58 and 60 force the balls 52 outward, whereupon they may rest within a plurality of recesses, such as the recess 62 shown in FIG. 1. These recesses 62, in combination with the balls 50 and 52, give the user a tactile response when the engagement levers 36 and 38 are in a proper orientation. Such combinations are well known in the art and are often called "bullet catches."

In one embodiment, the engagement levers 36 and 38 are of different lengths between the center of the clearance hole 70 and the outward end 67 of the user engagement portion 66. In this way, the longer lever may be installed on the user's thumb side of the firearm and the shorter lever on the opposite side so as to improve thumb-side activation without the finger side interfering with firing of the firearm. As the inner portion 74 of each engagement levers 36 and 38 is substantially identical, the levers are reversible.

Figure 8:
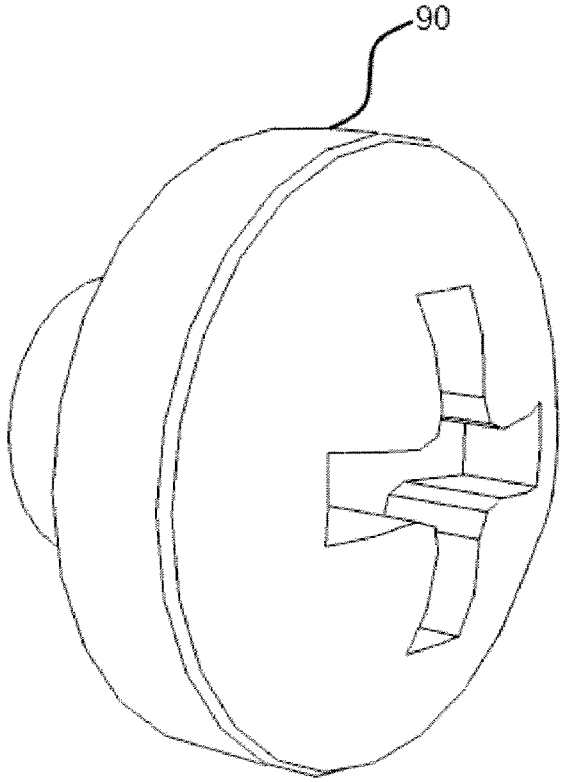
FIG. 8 is an isometric view of a button cover, in one form.

In another embodiment, one of the levers may be replaced with a substantially flush button 90, as shown in FIG. 8. In this embodiment, one side of the safety mechanism is removed so as to completely avoid any interference of the safety mechanism on one side of the firearm. While this embodiment does not allow for ambidextrous use while the button 90 is in place, the button 90 may be replaced at any point with one of the levers 36 or 38 by the user.

Figure 3:
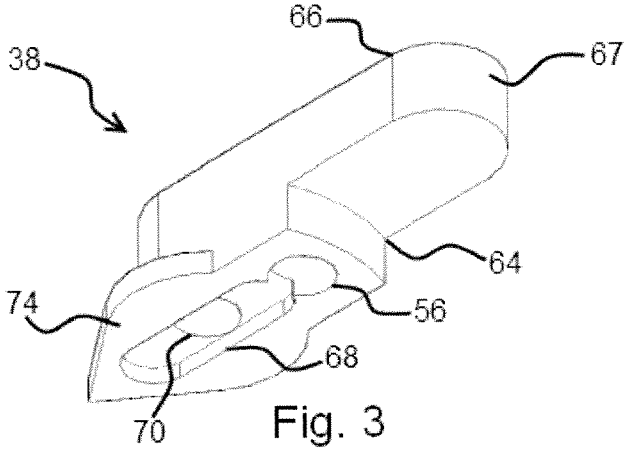
FIG. 3 is an isometric view of the inner portion of the engagement lever, in one form.

Moving onto FIG. 3, the engagement lever 38 is shown, from what might be generally considered as the inner portion, the portion adjacent the side wall of the firearm 22. As previously discussed, the spring receiver 56 can be more easily seen and generally comprises a cylinder-shaped opening that receives the spring 60 and ball 52. It can also be seen how there exists, in one form, an offset 64, such that the engagement portion 66 is not in direct contact with the outer surface of the firearm 22, which would make it easier for the user to rotate the engagement lever 38 without being concerned about pinching his/her fingers against the side wall of the firearm 22. Furthermore, a non-cylindrical surface 68 is shown adjacent the clearance hole 70, through which the fastener 42 passes. This non-cylindrical surface 68 corresponds to a non-cylindrical surface 72 in one end of the pin 34. This allows for the engagement lever 38 to exert additional rotational force against the pin 34, as opposed to simply relying on frictional pressure between the inner portion 74 of the lever 38 and the pin 34. As long as the non-cylindrical surface 68 corresponds to the shape and size of the non-cylindrical surface 72, rotational force will be more easily transferred between the lever 38 and pin 34 without "slippage."

Figure 4:
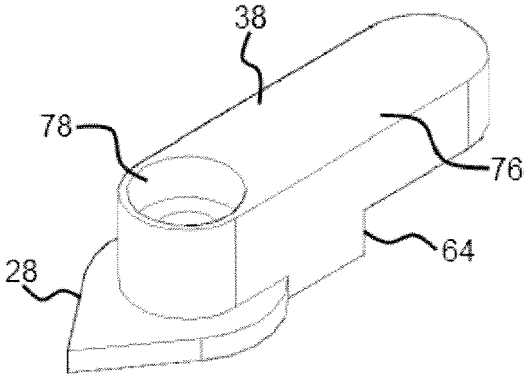
FIG. 4 is an isometric view of the outer portion of the engagement lever, in one form.
Figure 5:
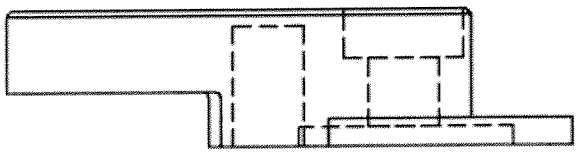
FIG. 5 is a side hidden line view of the engagement lever, in one form.

As shown in FIG. 4, the engagement lever 38 also includes an outer portion 76, which is generally opposite the inner portion 74. Additionally, a countersink recess 78 may be included to receive the head portion 80 of the fastener 42. In one form, the indicator portion 28 of the engagement lever 38 is formed in a shape that would clearly indicate to the user the direction or orientation of the engagement lever 38 relative to the firearm 22, to most clearly show to the user the "mode" in which the firearm is set, whether this be a safe, firing, automatic, or other "mode."

Figure 6:
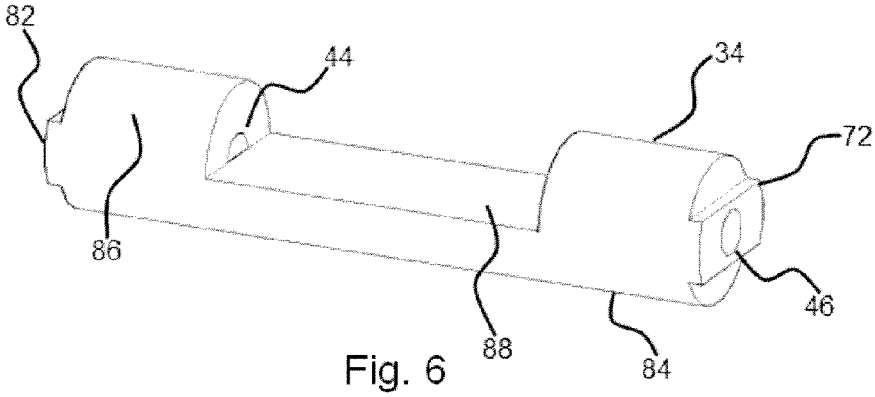
FIG. 6 is an isometric view of the pin, in one form.

Now looking to FIG. 6, the pin 34 is shown and generally comprises the non-cylindrical protrusion 72 previously described on one end, and another non-cylindrical protrusion 82 on the opposite end. Additionally, the tapped holes 44 and 46 can also be seen. To allow for rotation of the pin 34, the pin 34 comprises a plurality of cylindrical portions 84 and 86, which may be disposed on alternate ends of the pin 34. Additionally, the pin 34 comprises a cam portion or clearance portion 88. It is this cam portion 88 that engages the trigger mechanism coupled to the trigger 24, to allow the trigger 24 to be repositioned by the user for firing of the weapon, or alternately, to prohibit motion of the trigger 24, firing pin, or other portions of the trigger mechanism. This prohibits the trigger 24 from repositioning and/or allowing the firing pin within the firearm 22 to engage any shell or cartridge. Such mechanisms are well known in the art, such as the four-position firearm fire control selector, found in U.S. Pat. No. 5,760,328 and incorporated herein by reference.

Figure 7:
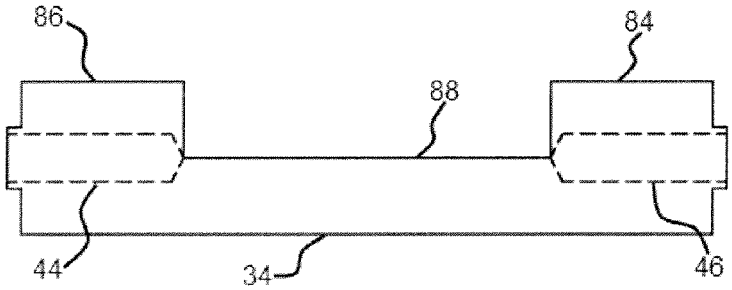
FIG. 7 is a side hidden line view of the pin, in one form.

Looking to FIG. 7, the cam portion 88 and cylindrical portions 84 and 86 can be seen from a different angle, which may enhance the user's understanding of how these parts interoperate. Furthermore, the tapped holes 44 and 46 can be seen as the dashed lines on either end of the pin 34. Of particular note, these tapped holes 44 and 46 do not, in this embodiment, extend onto the cam portion 88, which could interfere with operation of the pin 34.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. A retrofit safety lever for a firearm, the safety lever comprising:

a. a pin comprising;
   i. substantially cylindrical longitudinal end portions;
   ii. a clearance/cam portion between the substantially cylindrical end portions;
   iii. a non-cylindrical face surface on at least one longitudinal end face;
   iv. a receiving surface parallel to a longitudinal axis of the pin;

b. a first engagement lever comprising;
   i. a surface defining a clearance hole;
   ii. a mating surface operatively configured to engage the non-cylindrical face surface of the pin to facilitate rotational engagement between the first engagement lever and the pin;
   iii. a user engagement portion operatively configured to provide leverage to a user rotating the first engagement lever;
   iv. an indicator portion operatively configured to display to the user the relative rotation position of the pin;

c. a first fastener comprising:
   i. a first end with a minor diameter smaller than the clearance hole in the first engagement lever;
   ii. the first end being configured to engage the surface defining the receiving surface of the pin; and
   iii. a second end with a major diameter larger than the clearance hole in the first engagement lever.

2. The safety lever as recited in claim 1 further comprising:

a. a second engagement lever comprising;

i. a surface defining a clearance hole;

ii. a mating surface operatively configured to engage the non-cylindrical face surface of the pin opposite the first engagement lever to facilitate rotational engagement between the second engagement lever and the pin;

iii. a user engagement portion operatively configured to provide leverage to a user rotating the second engagement lever;

iv. an indicator portion operatively configured to display to the user the relative rotation position of the pin;

b. a second fastener comprising:

i. a first end with a minor diameter smaller than the clearance hole in the second engagement lever;

ii. the first end being configured to engage the receiving surface of the pin; and iii. a second end with a major diameter larger than the clearance hole in the second engagement lever.

3. The safety lever as recited in claim 2 wherein the first engagement lever and second engagement levers are substantially identical.

4. The safety lever as recited in claim 2 further comprising:

a. a surface defining a spring receiver in each of the first and second engagement levers;

b. an indexing member operatively configured to at least partially be received in each spring receiver; and c. a compression spring operatively configured to fit within each spring receiver and bias the indexing member toward an indexing recess of the firearm.

5. The safety lever as recited in claim 4 wherein the mating surface of the indexing member and the non-cylindrical face surface of the pin are bilaterally configured to allow connection of the indexing member to the non-cylindrical face surface of the pin in at least two unique orientations at 180° opposition.

* * * * *